US010916365B2

(12) United States Patent
Shitama et al.

(10) Patent No.: US 10,916,365 B2
(45) Date of Patent: Feb. 9, 2021

(54) REACTOR AND REACTOR MANUFACTURING METHOD

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Seiji Shitama, Mie (JP); Masayuki Kato, Mie (JP); Takashi Misaki, Mie (JP); Tatsuo Hirabayashi, Mie (JP); Shinichiro Yamamoto, Mie (JP); Akinori Ooishi, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 209 days.

(21) Appl. No.: 15/746,080

(22) PCT Filed: Jul. 14, 2016

(86) PCT No.: PCT/JP2016/070899
§ 371 (c)(1),
(2) Date: Jan. 19, 2018

(87) PCT Pub. No.: WO2017/018237
PCT Pub. Date: Feb. 2, 2017

(65) Prior Publication Data

US 2018/0211758 A1 Jul. 26, 2018

(30) Foreign Application Priority Data

Jul. 24, 2015 (JP) ..... 2015-146551

(51) Int. Cl.
*H01F 27/02* (2006.01)
*H01F 27/32* (2006.01)
(Continued)

(52) U.S. Cl.
CPC ..... *H01F 27/022* (2013.01); *H01F 27/24* (2013.01); *H01F 27/2823* (2013.01);
(Continued)

(58) Field of Classification Search
CPC ..... H01F 27/324; H01F 27/022
See application file for complete search history.

(56) References Cited

U.S. PATENT DOCUMENTS

2010/0026434 A1* 2/2010 Okamoto ..... H01F 27/266 336/65
2010/0079230 A1* 4/2010 Brubaker ..... H01F 37/00 336/196
(Continued)

FOREIGN PATENT DOCUMENTS

JP 52-138243 B2 10/1977
JP 52138243 U * 10/1977 ..... H01F 27/26
(Continued)

OTHER PUBLICATIONS

Search Report for PCT/JP2016/070899, dated Oct. 4, 2016.

*Primary Examiner* — Elvin G Enad
*Assistant Examiner* — Malcolm Barnes
(74) *Attorney, Agent, or Firm* — Honigman LLP

(57) ABSTRACT

Provided is a reactor including: a coil having winding portions formed by winding a wire; a magnetic core that forms a closed magnetic circuit with inner core portions arranged inside of the winding portions and outer core portions arranged outside of the winding portions; end surface interposed members that are interposed between axial direction end surfaces of the winding portions and the outer core portions; and an inner resin portion that fills spaces between inner circumferential surfaces of the winding portions and outer circumferential surfaces of the inner core portions, the end surface interposed members including
(Continued)

turn storage portions that store at least a portion of turns of the axial direction end portions of the winding portions.

12 Claims, 7 Drawing Sheets

(51) Int. Cl.

| | |
|---|---|
| ***H01F 37/00*** | (2006.01) |
| ***H01F 27/24*** | (2006.01) |
| ***H01F 27/28*** | (2006.01) |
| ***H01F 41/06*** | (2016.01) |
| ***H01F 41/12*** | (2006.01) |

(52) U.S. Cl.
CPC ..... *H01F 27/32* (2013.01); *H01F 27/327* (2013.01); *H01F 37/00* (2013.01); *H01F 41/06* (2013.01); *H01F 41/127* (2013.01)

(56) References Cited

U.S. PATENT DOCUMENTS

2012/0119869 A1* 5/2012 Yamamoto ..... H01F 3/08 336/212
2012/0126928 A1* 5/2012 Yoshikawa ..... H01F 37/00 336/221
2013/0088317 A1* 4/2013 Tawara ..... H01F 17/06 336/212
2015/0162119 A1* 6/2015 Nakatsu ..... H01F 27/306 336/105
2016/0343490 A1* 11/2016 Maeno ..... H01F 27/2847

FOREIGN PATENT DOCUMENTS

JP 2014003125 A * 1/2014
JP 2015-122484 A 7/2015

* cited by examiner

REACTOR AND REACTOR MANUFACTURING METHOD

CROSS-REFERENCE TO RELATED APPLICATIONS

This application is the U.S. national stage of PCT/JP2016/070899 filed Jul. 14, 2016, which claims priority of Japanese Patent Application No. JP2015-146551 filed Jul. 24, 2015.

TECHNICAL FIELD

The present invention relates to a reactor and a reactor manufacturing method.

The present application claims priority based on Japanese Patent Application No. 2015-146551 filed on Jul. 24, 2015, the content of which is incorporated herein in its entirety.

BACKGROUND

A reactor disclosed in JP 2014-003125A includes a coil with winding portions, a magnetic core that forms a closed magnetic circuit, and an interposed insulating member that ensures insulation between the coil and the magnetic core. The magnetic core includes an inner core portion that is arranged inside of the winding portion and an outer core portion that is arranged outside of the winding portion. With the reactor of the JP 2014-003125A, the interposed insulating member is constituted by combining a pair of bobbins. The bobbins can be divided into inner interposed members that are interposed between the inner circumferential surfaces of the winding portions and the inner core portions, and end surface interposed members that are interposed between the axial direction end surfaces of the winding portions and the outer core portions. Also, JP 2014-003125A discloses a reactor obtained by combining a coil, a magnetic core, and an interposed insulating member and thereafter filling the interior of the winding portion of the coil with resin.

SUMMARY

A reactor of the present disclosure is a reactor includes a coil having winding portions that are formed by winding a wire; a magnetic core that forms a closed magnetic circuit with inner core portions arranged inside of the winding portions and outer core portions arranged outside of the winding portions; end surface interposed members that are interposed between axial direction end surfaces of the winding portions and the outer core portions; and wherein an inner resin portion that fills spaces between inner circumferential surfaces of the winding portions and outer circumferential surfaces of the inner core portions, and wherein the end surface interposed members include turn storage portions that store at least a portion of turns of the axial direction end portions of the winding portions.

A reactor manufacturing method of the present disclosure is a reactor manufacturing method for manufacturing a reactor including a coil and a magnetic core that is arranged inside and outside of the coil and forms a closed magnetic circuit, wherein the reactor is the disclosed reactor, the method including: an assembly step of arranging the inner core portions inside of the winding portions and storing the axial direction end portions of the winding portions in the turn storage portions of the end surface interposed members; and a filling step of filling spaces between the inner circumferential surfaces of the winding portions and the outer circumferential surfaces of the inner core portions.

DETAILED DESCRIPTION OF PREFERRED EMBODIMENTS

Figure 1:
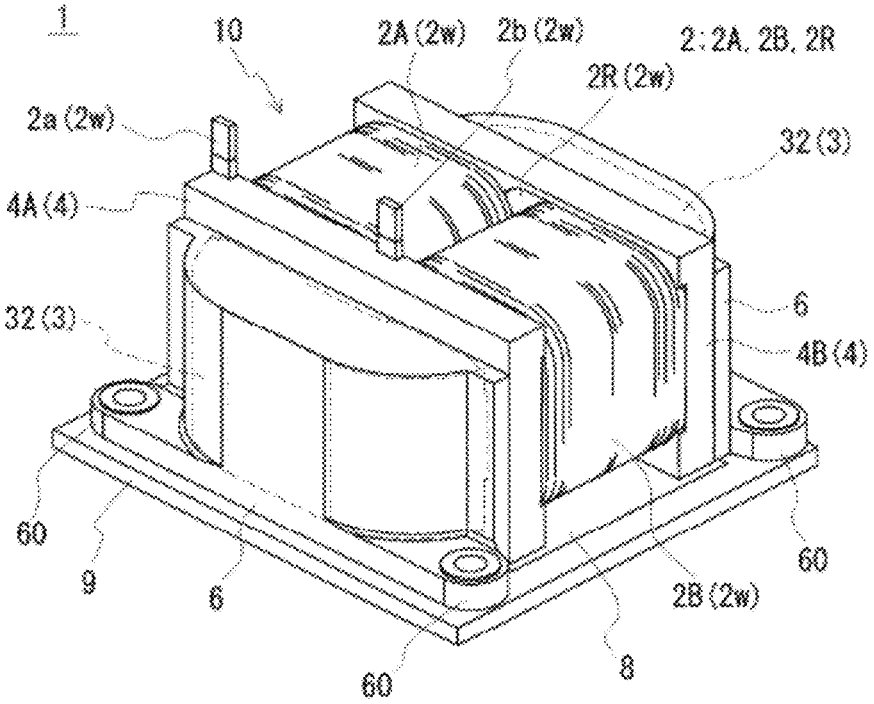
FIG. 1 is a perspective view of a reactor according to Embodiment 1.

With the configuration of JP 2014-003125A, there are cases where the resin with which the interiors of the winding portions are filled tends to leak to the outside of the winding portions through gaps between the axial direction end surfaces of the winding portions and the end surface interposed members and thus the winding portions cannot be filled sufficiently with the resin. Due to the resin with which the interiors of the winding portions are filled covering the portions between the inner circumferential surfaces of the winding portions and the outer circumferential surfaces of the inner core portions, the inner core portions can be held in the winding portions. However, if the filling of the winding portions with the resin is insufficient, the inner core portions tend to be unstable inside of the winding portions, and thus there is a risk that noise will occur or the inner core portions will come into contact with the inner circumferential surfaces of the winding portions.

In view of this, the present disclosure aims to provide a reactor in which resin leakage from between the end surface interposed members and the axial direction end surfaces of the coil is suppressed, and a manufacturing method for the same.

Effect of the Present Disclosure

The reactor of the present invention is a reactor in which resin leakage from between the end surface interposed member and the winding portions is suppressed.

The reactor manufacturing method of the present disclosure can be used to produce the reactor of the present disclosure.

First, embodiments of the present invention will be listed and described.

<1> A reactor of an embodiment is a reactor that includes: a coil having winding portions that are formed by winding a wire; a magnetic core that forms a closed magnetic circuit with inner core portions arranged inside of the winding portions and outer core portions arranged outside of the winding portions; and end surface interposed members that are interposed between axial direction end surfaces of the winding portions and the outer core portions. The reactor includes an inner resin portion that fill spaces between the inner circumferential surfaces of the winding portions and the outer circumferential surfaces of the inner core portions, and the end surface interposed members of the reactor include turn storage portions that store at least a portion of turns of the axial direction end portions of the winding portions.

Due to the turn storage portions being formed on the end surface interposed members, the end surface interposed members and the axial direction end surfaces of the winding portions can be brought into surface contact with each other, and when the interiors of the winding portions are filled with the resin in the process of manufacturing the reactor, it is possible to suppress a case in which the resin leaks from the contact portions between the end surface interposed members and the winding portions. Also, due to at least a portion of the turns of the axial direction end portions of the winding portions being stored in the turn storage portions, or in other words, due to at least a portion in the thickness direction of the turns of the axial direction end portions being covered by the inner walls of the turn storage portions, resin leakage from the contact portions can be suppressed compared to the case where the end surface interposed members and the axial direction end surfaces of the winding portions are in surface contact with each other. As described above, by using the end surface interposed members that have the turn storage portions, it is possible to achieve a reactor in which resin leakage from between the end surface interposed members and the winding portions is suppressed. An inner resin portion that is formed by filling the interiors of the winding portions with sufficient resin during manufacturing of the reactor is included in the reactor in which resin leakage from between the end surface interposed members and the winding portions is suppressed. If this kind of inner resin portion is used, it is possible to hold the inner core portions inside of the winding portions.

<2> Examples of the reactor of an embodiment can include a mode in which the coil includes integration resin that is provided separately from the inner resin portion and integrates the turns of the winding portions.

Production of the above-described reactor is simple. With the above-described reactor, the winding portions are not easily bent due to the turns being integrated, and the magnetic core is easily arranged inside of the winding portion during manufacturing of the reactor. Also, due to the turns of the winding portions being integrated, large cracks are not likely to form between the turns, and thus it is possible to reduce the likelihood that the resin with which the interiors of the winding portions are filled during manufacturing of the reactor will leak from between the turns. As a result, large voids are not likely to be formed in the winding portions. Voids between the turns can also be eliminated using integration resin.

<3> Examples of the reactor of an embodiment can include a mode in which the end surface interposed members include resin filling holes through which the interiors of the winding portions are filled with resin that forms the inner resin portion.

By forming the resin filling holes in the end surface interposed members, it is possible to easily fill the interiors of the winding portions with resin when manufacturing the reactor. Also, when the interiors of the winding portions are filled with the resin through the resin filling holes, winding portions that have been hardened with integration resin are used, whereby resin leakage from the interiors of the winding portions to the outside can be effectively suppressed.

<4> Examples of the reactor of an embodiment in which resin filling holes are included in end surface interposed members can include a mode in which an outer resin portion that integrates the outer core portions with the end surface interposed members is included, wherein the outer resin portion and the inner resin portion are connected through the resin filling holes.

Since the outer resin portion and the inner resin portion are connected through the resin filling hole, it is possible to form both resin portions through one instance of molding. In other words, the reactor including this configuration can be obtained through one instance of resin molding, regardless of the fact that the outer resin portion is included in addition to the inner resin portion, and therefore the reactor has excellent productivity.

<5> Examples of the reactor of an embodiment including resin filling holes can include a mode in which the end surface interposed members include through holes into which the outer core portions are fit, the resin filling holes are formed by gaps between the through holes and the outer core portions fit into the through holes, and gaps are formed between the outer core portions and the inner core portions by the inner resin portion that has entered the interiors of the through holes.

The reactor can be manufactured without preparing a separate gap material such as alumina when gaps are formed between the outer core portions and the inner core portions, and thus the reactor has excellent productivity.

<6> Examples of the reactor of an embodiment can include a mode in which the inner core portions are constituted by a plurality of divided cores and the inner resin portion that has entered between the divided cores.

The inner resin portion that has entered between the divided cores functions as gaps that adjust the magnetic property of the magnetic core. In other words, the reactor including this configuration does not require a gap material made of another material such as alumina, and therefore has excellent productivity due to not requiring the gap material.

<7> Examples of the reactor of an embodiment can include a mode in which the inner core portions include a plurality of divided cores, the reactor comprises inner interposed members that are interposed between the inner circumferential surfaces of the winding portions and the outer circumferential surfaces of the inner core portions, and the inner interposed members include storage portions that store the divided cores in a separated state.

By using the inner interposed members, when the winding portions are filled with the resin in the process of manufacturing the reactor, the winding portions and the divided cores constituting the inner core portions can be reliably separated, and insulation between the winding portions and the inner core portions can be reliably ensured. Also, by providing the storage portions on the inner interposed members, the divided cores constituting the inner core portions can be easily arranged at predetermined positions inside of the winding portions. As a result, a reactor having stable magnetic properties can be manufactured with good productivity. In addition, by filling the crevices between the divided cores with the inner resin portion, it is possible to easily form resin gaps between the divided cores.

<8> Examples of the reactor of an embodiment can include a mode in which inner interposed members that are interposed between the inner circumferential surfaces of the winding portions and the outer circumferential surfaces of the inner core portions are included, wherein the inner resin portion is constituted by the same material as at least one of the end surface interposed members and the inner interposed members.

According to the above-described configuration, the linear expansion coefficients of the inner resin portion and the inner interposed members (end surface interposed members)

can be made the same. As a result, even if the inner resin portion and the inner interposed members (end surface interposed members) undergo thermal expansion or contraction during use of the reactor, cracks and the like are not likely to occur in the inner resin portion. In view of these results, it is preferable that the inner resin portion, the inner interposed members, and the end surface interposed members are constituted by the same material.

<9> Examples of the reactor of an embodiment can include a mode in which inner interposed members that are interposed between the inner circumferential surfaces of the winding portions and the outer circumferential surfaces of the inner core portions are included; and sealing members that are interposed between the inner circumferential surfaces of the winding portions located near the end surface interposed members and the outer circumferential surfaces of the inner interposed members are included.

By providing the sealing members, when manufacturing the reactor, it is possible to more effectively suppress a case in which the resin leaks from between the end surface interposed members and the axial direction end surfaces of the winding portion.

<10> A reactor manufacturing method of an embodiment is a reactor manufacturing method for manufacturing a reactor including a coil and a magnetic core that is arranged inside and outside of the coil and forms a closed magnetic circuit, wherein the reactor is the reactor according to the above-described embodiment. The reactor manufacturing method of this embodiment includes: an assembly step of arranging the inner core portions inside of the winding portions and storing the axial direction end portions of the winding portions in the turn storage portions of the end surface interposed members; and a filling step of filling the space between the inner circumferential surfaces of the winding portion and the outer circumferential surfaces of the inner core portion with resin.

According to the above-described reactor manufacturing method, it is possible to suppress a case in which the resin leaks from between the end surface interposed members and the axial direction end surfaces of the winding portions when the spaces between the inner circumferential surfaces of the winding portions and the outer circumferential surfaces of the inner core portions are filled with resin. Leakage of the resin can be suppressed because the turn storage portions that store the axial direction end portions of the winding portions are formed in the end surface interposed members. The resin with which the interiors of the winding portions are filled is an inner resin portion that bonds the inner circumferential surfaces of the winding portions and the outer circumferential surfaces of the inner core portions. As a result, the reactor of the embodiment is obtained.

<11> Examples of the reactor manufacturing method of an embodiment can include a mode in which the coil is produced using a wire having a heat-fusible resin on its surface, turns of the winding portions are integrated by melting the heat-fusible resin through a heat treatment, and thereafter the filling step is performed.

By producing the coil using a wire having heat-fusible resin, it is possible to form the integration resin that integrates the turns constituting the winding portions by merely subjecting the coil to a heat treatment. Also, by filling the interiors of the winding portions hardened with the integration resin with resin, it is possible to suppress resin leakage from between the turns of the winding portions, and it is possible to suppress a case in which a large void is formed in the interiors of the winding portions.

<12> Examples of the reactor manufacturing method of an embodiment can include a mode in which the end surface interposed members include resin filling holes for filling the interiors of the winding portions with the resin, and in the filling step, the interiors of the winding portions are filled with the resin via the resin filling holes.

By filling the interiors of the winding portions with resin via the resin filling holes formed in the end surface interposed members, the spaces between the inner circumferential surfaces of the winding portions and the outer circumferential surfaces of the inner core portions can be sufficiently filled with resin.

<13> Examples of the reactor manufacturing method of an embodiment in which end surface interposed members having resin filling holes are used include a mode in which in the filling step, the filling with the resin is performed through injection molding.

By filling the winding portions with resin while applying pressure through injection molding, the resin can be sufficiently spread in the small gaps between the winding portions and the inner core portions. Also, by performing filling with the resin from the outer circumferential side of the outer core portions, it is possible to form both the outer resin portion and the inner resin portion in one instance of injection molding. This is because the resin that covers the outer circumferences of the outer core portions fills the interiors of the winding portions via the resin filling holes as well.

Hereinafter, embodiments of the reactor of the present invention will be described with reference to the drawings. Items with the same name are denoted by the same reference numerals in the drawings. Note that the present invention is not necessarily limited to the configurations shown in the embodiments, and is defined by the claims, and all meanings equivalent to the claims and all modifications within the scope are intended to be encompassed therein.

Embodiment 1

Embodiment 1 will describe a configuration of a reactor 1 with reference to FIGS. 1 to 6. The reactor 1 shown in FIG. 1 includes a combination body 10 obtained by combining a coil 2, a magnetic core 3, and an interposed insulating member 4, and a mounting plate 9 on which the combination body 10 is mounted. The combination body 10 further includes an inner resin portion 5 (see FIG. 2) that is arranged inside of winding portions 2A and 2B of the coil 2, and an outer resin portion 6 that covers outer core portions 32 that constitute part of the magnetic core 3. Hereinafter, configurations of the reactor 1 will be described in detail.

Combination Body

Coil

Figure 3:
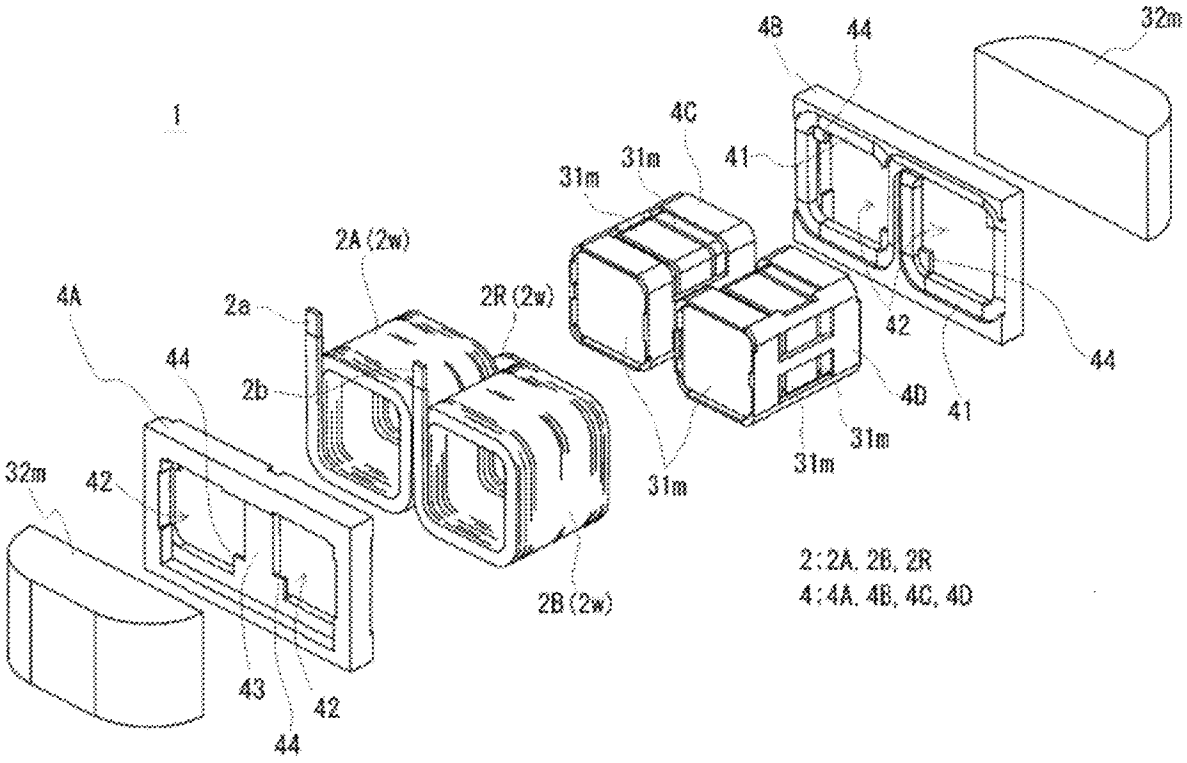
FIG. 3 is an exploded perspective view of the combination body, excluding resin portions.

As shown in FIG. 3, the coil 2 of the present embodiment is constituted by one wire 2*w* and includes a pair of winding portions 2A and 2B and a joining portion 2R that joins the winding portions 2A and 2B. The winding portions 2A and 2B are formed into hollow tube shapes with the same number of windings and the same winding direction, and are aligned such that the axial directions thereof are parallel. The coil 2 may be manufactured by joining the winding portions 2A and 2B produced using separate wires.

The winding portions 2A and 2B of the present embodiment are formed into rectangular tube shapes. The rectangular tube-shaped winding portions 2A and 2B are winding portions whose end surface shapes are quadrangular (includes being square-shaped) with rounded corners. Of course, the winding portions 2A and 2B may be formed in cylindrical shapes. The cylindrical winding portions are winding portions whose end surface shapes are closed surfaces (oval, circular, racetrack-shaped, etc.).

The coil 2 including the winding portions 2A and 2B can be formed using a covered wire that includes an insulation covering composed of an insulating material on the outer circumference of a conductor such as a rectangular wire or a round wire composed of a conducting material such as copper, aluminum, magnesium, or an alloy thereof. With the present embodiment, by performing edgewise winding on a covered rectangular wire with a conductor composed of a copper rectangular wire (wire 2*w*) and an insulation covering composed of enamel (e.g., polyamide-imide), the winding portions 2A and 2B are formed.

Both end portions 2*a* and 2*b* of the coil 2 are pulled out from the winding portions 2A and 2B and are connected to a terminal member (not shown). The insulation covering such as enamel is peeled off on the two end portions 2*a* and 2*b*. An external apparatus such as a power source that performs power supply to the coil 2 is connected via the terminal member.

The coil 2 having the above-described configuration is preferably integrated with resin. In the case of the present example, the winding portions 2A and 2B of the coil 2 are separately integrated using integration resin 20 (see FIG. 2). The integration resin 20 of the present example is formed by fusing the covering layer of the heat-fusible resin formed on the outer circumference of the wire 2*w* (the further outer circumference of the insulation covering such as enamel), and the integration resin 20 is very thin. For this reason, even if the winding portions 2A and 2B are integrated using the integration resin 20, the shape of the turns and the boundaries of the turns of the winding portions 2A and 2B can be seen. Examples of the material for the integration resin 20 can include resin that is fused by heat, such as heat-curable resin such as epoxy resin, silicone resin, or unsaturated polyester.

Figure 2:
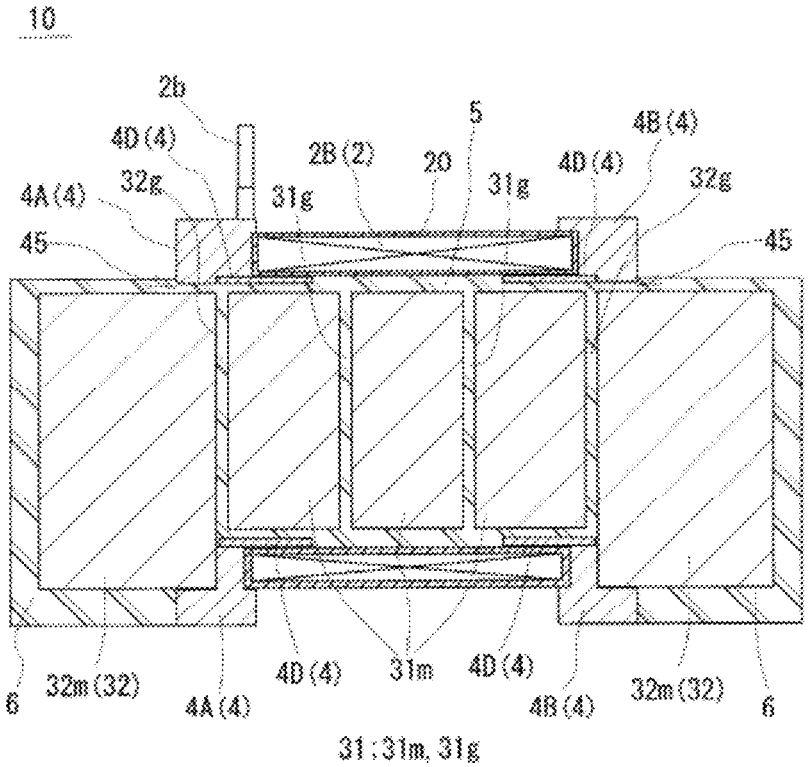
FIG. 2 is a lateral cross-sectional view of a combination body included in the reactor.

FIG. 2 shows an exaggerated view of the integration resin 20, but in actuality, the integration resin 20 is formed very thinly. The integration resin 20 integrates the turns that form the winding portion 2B (same for the winding portion 2A) and prevents expansion and contraction in the axial direction of the winding portion 2B. In the present embodiment, the integration resin 20 is formed by fusing the heat-fusible resin formed on the wire 2*w*, and therefore the integration resin 20 uniformly enters the gaps between the turns. A thickness t1 of the integration resin 20 between the turns is approximately twice the thickness of the heat-fusible resin formed on the surface of the wire 2*w* before winding, and specifically, the thickness t1 is set to be at least 20 μm and at most 2 mm. By making the thickness t1 thicker, it is possible to strongly integrate the turns, and by making the thickness t1 thinner, it is possible to suppress a case in which the axial length of the winding portion 2B becomes too long.

A thickness t2 of the integration resin 20 on the outer circumferential surface and the inner circumferential surface of the winding portion 2B is approximately the same as the thickness of the heat-fusible resin that is formed on the surface of the wire 2*w* before winding, and the thickness t2 is set to be at least 10 μm and at most 1 mm. By setting the thickness t2 of the integration resin 20 on the inner circumferential surface and the outer circumferential surface of the winding portion 2B to 10 μm or more, it is possible to strongly integrate the turns of the winding portions 2A and 2B such that the turns do not come apart. Also, by setting the above-described thickness to 1 mm or less, it is possible to suppress a reduction in the heat dissipation property of the winding portion 2B caused by the integration resin 20.

Here, the winding portions 2A and 2B of the rectangular tube-shaped coil 2 are divided into four corner portions formed by bending the wire 2*w*, and flat portions at which the wire 2*w* is not bent. In FIGS. 1 and 2, the turns are integrated with the integration resin 20 at the corner portions and the flat portions of the winding portions 2A and 2B. In contrast to this, the turns may be integrated with the integration resin 20 only at portions of the winding portions 2A and 2B, such as the corner portions.

The inner sides of the curves (the upper side in the drawing) tend to be thicker than the outer sides of the curves (the lower side in the drawing) at the corner portions of the winding portions 2A and 2B formed by subjecting the wire 2*w* to edgewise winding. When these winding portions 2A and 2B in which the inner sides of the curves are thicker are subjected to heat treatment to fuse the heat-fusible resin on the surface of the wire 2*w*, the turns can be integrated with the integration resin 20 at the inner sides of the curves, and the turns can be separated on the outer sides of the curves. In this case, there is heat-fusible resin on the outer circumference of the wire 2*w* at the flat portions of the winding portions 2A and 2B, but the turns are separated without being integrated. If the gaps at the flat portions are sufficiently small, even if the interiors of the winding portions 2A and 2B are filled with resin, the resin cannot pass through the gaps at the flat portions due to surface tension.

Magnetic Core

The magnetic core 3 is formed by combining multiple divided cores 31*m* and 32*m* and can be divided into inner core portions 31 and 31 and outer core portions 32 and 32 for the sake of convenience (see FIGS. 1 and 2 as well).

The inner core portions 31 are portions that are arranged inside of the winding portion 2B (same for the winding portion 2A as well) of the coil 2, as shown in FIG. 2. Here, the inner core portions 31 refer to portions of the magnetic core 3 that extend in the axial direction of the winding portions 2A and 2B of the coil 2. For example, in FIG. 2, although the end portions of the portions extending in the axial direction of the winding portions 2A and 2B protrude to the outside of the winding portions 2A and 2B relative to the end surfaces of the winding portions 2A and 2B, the protruding portions are also part of the inner core portions 31.

The inner core portions 31 of the present example are each constituted by three divided cores 31*m*, gaps 31*g* formed between the divided cores 31*m*, and gaps 32*g* formed between the divided cores 31*m* and the later-described divided cores 32*m*. The gaps 31*g* and 32*g* of the present example are formed using the later-described inner resin portion 5. The shape of the inner core portions 31 is a shape that conforms to the shape of the interior of the winding portion 2A (2B), and in the case of the present example, it is a roughly cuboid shape.

On the other hand, the outer core portions 32 are portions arranged outside of the winding portions 2A and 2B and have shapes such that they connect the end portions of the pair of inner core portions 31 and 31 (see FIG. 1). The outer core portions 32 of the present example are constituted by column-shaped divided cores 32*m* whose upper surfaces and lower surfaces are approximately dome-shaped. The lower surfaces of the outer core portions 32 (lower surfaces of the divided cores 32*m*) are approximately level with the lower surfaces of the winding portions 2A and 2B of the coil 2 (see FIG. 2).

The divided cores 31*m* and 32*m* are compaction bodies that are formed by pressure molding raw material powder including soft magnetic powder. The soft magnetic powder is an aggregate of magnetic particles constituted by an iron group metal such as iron, an alloy thereof (Fe—Si alloy, Fe—Ni alloy, etc.), or the like. A lubricant may be included in the raw material powder. Unlike the present example, the divided cores 31*m* and 32*m* can also be formed by molding a complex material including soft magnetic powder and resin. The same soft magnetic powder and resin that can be used in the compaction body can be used as the soft magnetic powder and resin in the complex material. An insulation covering constituted by a phosphate or the like may be formed on the surface of the magnetic particles. Otherwise, the divided cores 31*m* and 32*m* can also be formed of layered steel plates.

Interposed Insulating Member

As shown in FIGS. 2 and 3, the interposed insulating member 4 is a member that ensures insulation between the coil 2 and the magnetic core 3 and is constituted by end surface interposed members 4A and 4B and inner interposed members 4C and 4D. The interposed insulating member 4 can be formed of a thermoplastic resin, such as polyphenylene sulfide (PPS) resin, polytetrafluoroethylene (PTFE) resin, liquid crystal polymer (LCP), polyamide (PA) resin such as nylon 6 or nylon 66, polybutylene terephthalate (PBT), or acrylonitrile butadiene styrene (ABS) resin. Other than this, the interposed insulating member 4 can be formed using a heat-curable resin, such as unsaturated polyester resin, epoxy resin, urethane resin, or silicone resin. The heat dissipation property of the interposed insulating member 4 may be improved by including a ceramic filler in the resin. For example, a non-magnetic powder such as alumina or silica can be used as the ceramic filler.

End Surface Interposed Members

Figure 4:
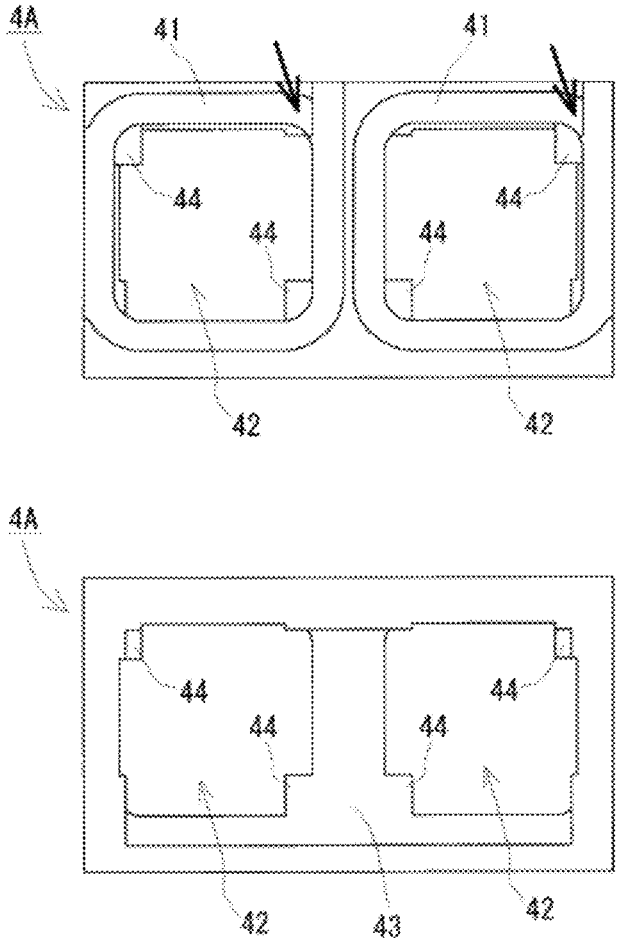
FIG. 4 is a schematic diagram of an end surface interposed member included in the reactor.

The end surface interposed members 4A and 4B will be described mainly with reference to FIGS. 3 and 4. The upper portion of FIG. 4 is a schematic perspective view from the coil 2 side of the end surface interposed member 4A on the left side of FIG. 3, and the lower portion is a schematic perspective view from the divided core 32*m* side of the end surface interposed member 4A. Here, the end surface interposed member 4B on the right side of FIG. 3 differs from the end surface interposed member 4A in FIG. 4 only in the configuration of the later-described turn storage portion 41. Accordingly, here, mainly the end surface interposed member 4A will be described.

Two turn storage portions 41 that store at least a portion of the axial direction end portions of the winding portions 2A and 2B are formed on the surface on the coil side of the end surface interposed member 4A. The turn storage portions 41 are formed in order to bring the entire axial direction end surface of the winding portions 2A and 2B into surface contact with the end surface interposed member 4A. More specifically, the turn storage portion 41 is formed in a quadrangular loop shape that surrounds the later-described through hole 42 and the depth gradually increases in a counterclockwise direction starting from the position of the corner portion in the upper right portion of the drawing (see the bold arrows). The right side portions of the turn storage portions 41 reach the upper end of the end surface interposed member 4A and the end portions 2*a* and 2*b* of the coil 2 shown in FIG. 3 can be pulled upward of the end surface interposed member 4A. Here, the turn storage portion 41 of the end surface interposed member 4B on the right side of FIG. 3 has an "8" shape that can store the end surfaces of the winding portions 2A and 2B that include the joining portion 2R.

The axial direction end surface of the winding portions 2A and 2B and the end surface interposed member 4A are brought into surface contact using the turn storage portion 41, and thus it is possible to suppress resin leakage from the contact portion. In addition to the surface contact, in the turn storage portion 41, at least a portion in the thickness direction of the turns of the axial direction end portions of the winding portions 2A and 2B is covered with an end surface interposed member 4A. Specifically, in the upper-side portion, the right-side portion, and the lower side portion of the turn storage portion 41 on the left side of the drawing, the circumferential surface portion of the turn of the winding portion 2B that fits into the turn storage portion 41 is covered by the end surface interposed member 4A (see FIG. 2 as well). In the upper-side portion, the left-side portion, and the lower side portion of the turn storage portion 41 on the right side of the drawing, the circumferential surface portion of the turn of the winding portion 2A that fits into the turn storage portion 41 is covered by the end surface interposed member 4A. The resin is even less likely to leak at the portion covered by the end surface interposed members 4A and 4B than at other portions. From the viewpoint of suppressing resin leakage from the contact portion between the winding portions 2A and 2B and the end surface interposed member 4A, it is preferable that the turn storage portions 41 store the entire circumference of the turns of the axial direction end portions of the winding portions 2A and 2B.

In addition to the above-described turn storage portion 41, the end surface interposed member 4A includes a pair of through holes 42 and 42 and a fitting portion 43 (see lower portion of drawing). The through holes 42 are holes for fitting the combined inner interposed members 4C and 4D and divided cores 31*m* shown in FIG. 3. On the other hand, the fitting portion 43 is a recessed portion for fitting the divided cores 32*m* that are to be the outer core portions 32.

Stopper portions 44 for stopping the above-described combined members are formed at the central lower portions and the outer upper portions of the through holes 42. The combined members and the divided core 32*m* are separated by the stopper portions 44 without coming into direct contact (see FIG. 3 as well).

Figure 6:
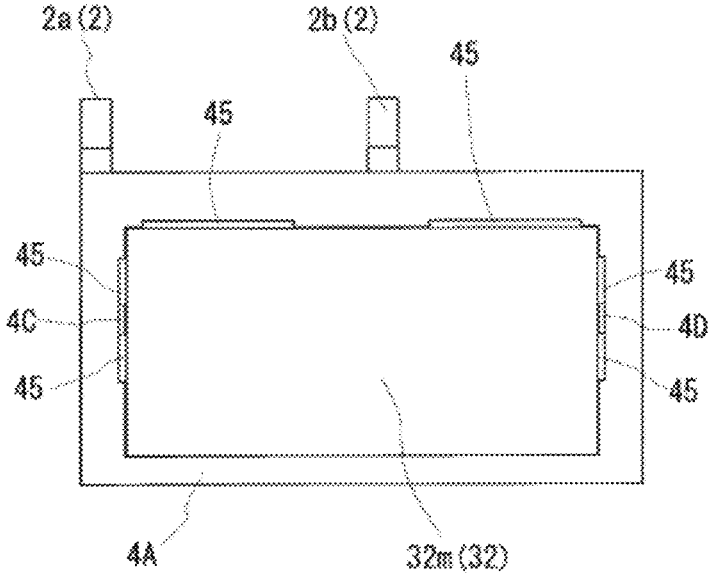
FIG. 6 is a schematic front view of the combination body before the resin portions are formed.

The outer portions and the upper portions of the through holes 42 are outwardly recessed. As shown in FIG. 6, the recessed portions form resin filling holes 45 at the side edges and upper edge of the divided core 32*m* when the divided core 32*m* is fit into the fitting portion of the end surface interposed member 4A. The resin filling holes 45 are holes that penetrate in the thickness direction of the end surface interposed member 4A from the outer core portion 32 (divided core 32*m*) side on the near side in the drawing, to the axial direction end surface side of the winding portions 2A and 2B on the far side in the drawing, and the resin filling holes 45 are in communication with the spaces between the inner circumferential surfaces of the winding portions 2A and 2B and the outer circumferential surfaces of the inner core portions 31 (divided cores 31*m*) (see FIG. 2 as well).

Inner Interposed Members

Figure 5:
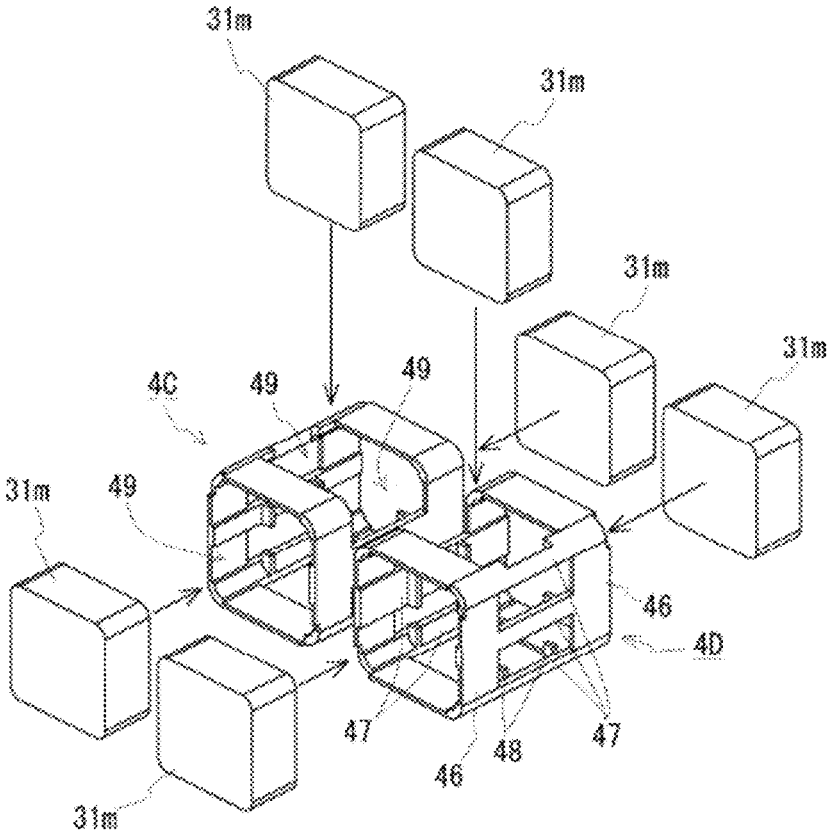
FIG. 5 is a schematic perspective view of an inner interposed member and a divided core included in the reactor.

The inner interposed members 4C and 4D will be described with reference to FIG. 5. The inner interposed member 4C and the inner interposed member 4D have the same shape, and the inner interposed member 4C is the same as the inner interposed member 4D if rotated 180 degrees horizontally. The inner interposed members 4C and 4D are cage-like members with openings at both ends. More specifically, the inner interposed members 4C and 4D are each constituted by a pair of tube portions 46 and 46 formed into rectangular tube shapes, and multiple bridge portions 47 that join both tube portions 46 and 46. On the sides opposing the other inner interposed members 4C and 4D on the upper sides of the inner interposed members 4C and 4D, no bridge portion 47 is formed, but large opening portions are formed. Multiple partitioning portions 48 that protrude on the inner side of the inner interposed members 4C and 4D are formed on the bridge portions 47 and the inner portions of the inner interposed members 4C and 4D are each divided into three segments in the axial direction by the partitioning portions 48. The divided portions function as storage portions 49 that store the divided cores 31*m*. In the present example, as indicated by the thick arrows in FIG. 5, the divided cores 31*m* can be inserted into the storage portions 49 via the opening portions on both ends in the axial direction of the inner interposed members 4C and 4C and via the openings in the upper portions of the inner interposed members 4C and 4D. The divided cores 31*m* are separated from each other by the partitioning portions 48.

Inner Resin Portion

As shown in FIG. 2, the inner resin portion 5 is arranged inside of the winding portion 2B (the same follows for the winding portion 2A (not shown)) and bonds the inner circumferential surface of the winding portion 2B and the outer circumferential surfaces of the divided cores 31*m* (inner core portions 31).

Since the winding portion 2B is integrated by the integration resin 20, the inner resin portion 5 is stored inside of the winding portion 2B without spanning between the inner circumferential surfaces and the outer circumferential surfaces of the turns of the winding portion 2B. Also, a portion of the inner resin portion 5 enters between the divided cores 31*m* and between the divided cores 31*m* and the divided cores 32*m*, forming the gaps 31*g* and 32*g*.

For example, it is possible to use a heat-curable resin such as epoxy resin, phenol resin, silicone resin, or urethane resin, a thermoplastic resin such as PPS resin, PA resin, a polyimide resin, or a fluoride resin, a room-temperature curable resin, or a low-temperature curable resin as the inner resin portion 5. The heat dissipation property of the inner resin portion 5 may be improved by adding a ceramic filler such as alumina or silica to these resins. The inner resin portion 5 is preferably constituted by the same material as the end surface interposed members 4A and 4B and the inner interposed members 4C and 4D. Due to the three members being constituted by the same material, it is possible to make the linear expansion coefficients of the three members the same and to suppress damage to the members accompanying thermal expansion and contraction.

Outer Resin Portion

As shown in FIGS. 1 and 2, the outer resin portion 6 is arranged so as to cover the entire outer circumferences of the divided cores 32*m* (outer core portions 32), fixes the divided cores 32*m* to the end surface interposed members 4A and 4B, and protects the divided cores 32*m* from the outside environment. Here, the lower surfaces of the divided cores 32*m* may be exposed from the outer resin portion 6. In this case, the lower portions of the divided cores 32*m* are preferably extended so as to be approximately level with the lower surfaces of the end surface interposed members 4A and 4B. Due to the lower surfaces of the divided cores 32*m* being brought into direct contact with the later-described mounting plate 9, or due to adhesive or an insulating sheet being interposed between the mounting plate 9 and the lower surfaces of the divided cores 32*m*, the heat dissipation property of the magnetic core 3 including the divided cores 32*m* can be improved.

The outer resin portion 6 of the present example is provided on the sides of the side end interposed members 4A and 4B on which the divided cores 32*m* are arranged, and does not reach the outer circumferential surfaces of the winding portions 2A and 2B. In view of the functions of the outer resin portion 6, namely fixing and protecting the divided cores 32*m*, the forming range of the outer resin portion 6 is sufficient as illustrated, and it can be said that it is preferable in that the amount of resin used can be reduced. Of course, the outer resin portion 6 may reach the winding portions 2A and 2B, unlike in the illustrated example.

As shown in FIG. 2, the outer resin portion 6 of the present example is connected to the inner resin portion 5 via the resin filling holes 45 of the end surface interposed members 4A and 4B. In other words, the outer resin portion 6 and the inner resin portion 5 are formed at the same time with the same resin. The outer resin portion 6 and the inner resin portion 5 can also be formed separately, unlike in the present example.

The outer resin portion 6 can be constituted by resin that is similar to the resin that can be used to form the inner resin portion 5. If the outer resin portion 6 and the inner resin portion 5 are connected as in the present example, the two resin portions 6 and 5 are constituted by the same resin.

In addition, a fixing portion 60 (see FIG. 1) for fixing the combination body 10 to the mounting plate 9 or the like is formed on the outer resin portion 6. For example, by embedding a collar constituted by highly-rigid metal or resin in the outer resin portion 6, a fixing portion 60 for fixing the combination body 10 to the mounting plate 9 with a bolt can be formed.

Sealing Members

Figure 7:
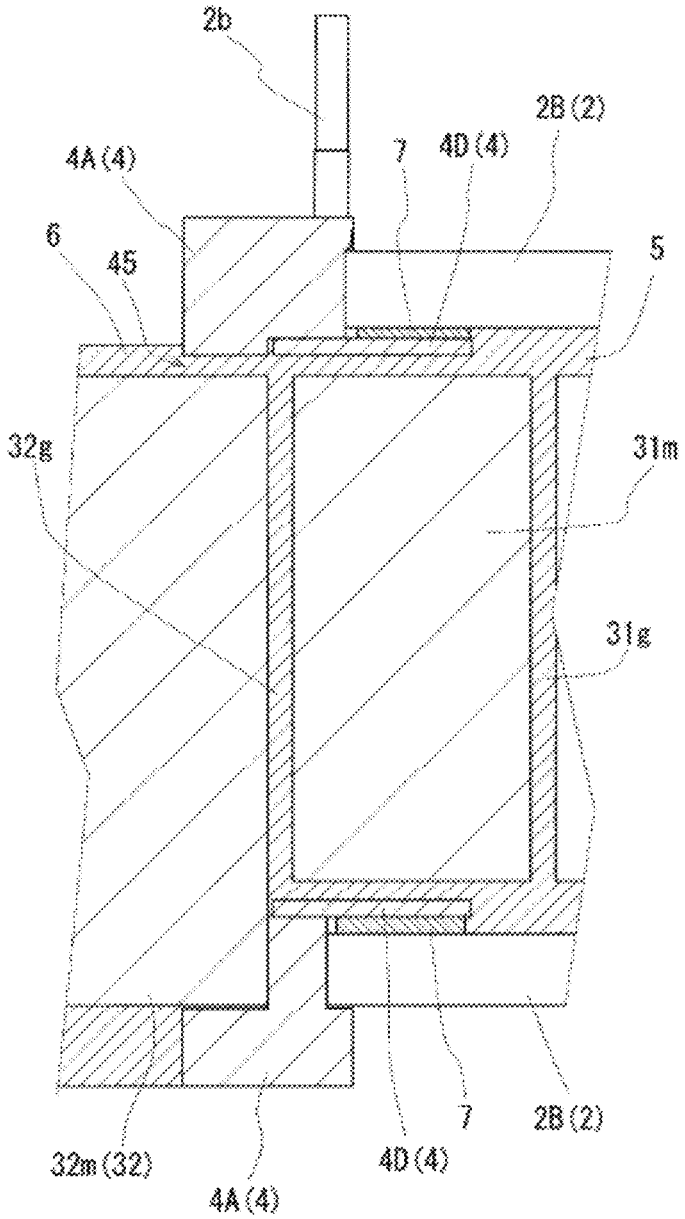
FIG. 7 is a partially-enlarged lateral cross-sectional view of the vicinity of the end surface interposed member of the combination body.

As shown in the partially-enlarged lateral cross-sectional view in FIG. 7, a sealing member 7 may be provided between the inner circumferential surface of the winding portion 2B (2A) near the end surface interposed member 4A and the outer circumferential surface of the inner interposed member 4D. By providing the sealing member 7, when the interior of the winding portion 2B is filled with the resin via the resin filling holes 45, the resin is less likely to go to the contact portion between the axial direction end surface of the winding portion 2B and the end surface interposed member 4A. For this reason, resin leakage from between the axial direction end surface of the winding portion 2B and the end surface interposed member 4A can be suppressed more effectively.

Ring-shaped packing can be used as the sealing member 7. In this case, it is preferable to insert the combined inner interposed member 4D and divided cores 31*m* into the winding portion 2B after the ring-shaped packing is attached to the outer circumference of the tube portion 46 (see FIG. 5) of the inner interposed member 4D.

Mounting Plate

As shown in FIG. 1, the reactor 1 of the present embodiment further includes the mounting plate 9 on which the combination body 10 is mounted. A bonding layer 8 that bonds the mounting plate 9 and the combination body 10 is formed between the mounting plate 9 and the combination body 10. The mounting plate 9 is preferably constituted by a material with excellent mechanical strength and heat transmittance, and for example, can be constituted by aluminum or an alloy thereof. The bonding layer 8 is preferably constituted by a material with an excellent insulation property, and for example, can be constituted by a heat-curable resin such as epoxy resin, silicone resin, or unsaturated polyester, or a thermoplastic resin such as PPS resin or LCP. The heat dissipation property of the bonding layer 8 may be improved by adding a ceramic filler or the like to the insulating resin.

The combination body 10 may be stored in a case. In this case, the bottom surface of the case functions as the mounting plate 9.

The combination body 10 can be used in a state of being immersed in a liquid refrigerant. Although there is no particular limitation, ATF (Automatic Transmission Fluid) or the like can be used as the liquid refrigerant in the case where the reactor 1 is used in a hybrid automobile. In addition, a fluorine-based inert liquid such as Fluorinert (registered trademark), a freon-based refrigerant such as HCFC-123 or HFC-134a, an alcohol-based refrigerant such as methanol or alcohol, a ketone-based refrigerant such as acetone, or the like can also be used as the liquid refrigerant.

Effect

With the reactor 1 of the present example, resin leakage from between the end surface interposed members 4A and 4B and the winding portions 2A and 2B is suppressed by the turn storage portions 41 formed on the end surface interposed members 4A and 4B. For this reason, the inner resin portion 5 that is formed by filling the interior of the winding portion with sufficient resin during manufacture is included in the reactor 1 according to which resin leakage from those portions is suppressed. If this kind of inner resin portion 5 is used, the inner core portions 31 and 31 can be held firmly inside of the winding portions 2A and 2B. As a result, it is possible to suppress a case in which the inner core portions 31 and 31 become unstable inside of the winding portions 2A and 2B, making it possible to suppress the occurrence of noise and contact between the winding portions 2A and 2B and the inner core portions 31 and 31.

Also, with the reactor 1 of the present example, the outer circumferences of the winding portions 2A and 2B of the coil 2 are not molded with resin and are directly exposed to the outside environment, and therefore the reactor 1 of the present invention is a reactor 1 with an excellent heat dissipation property. If the combination body 10 of the reactor 1 is immersed in the liquid refrigerant, the heat dissipation property of the reactor 1 can be further improved.

The reactor 1 of the present example can be used in a constituent portion of a power conversion apparatus such as a two-way DC-DC converter that is to be mounted in an electrically driven vehicle such as a hybrid automobile, an electric automobile, or a fuel-cell vehicle.

Reactor Manufacturing Method

Next, an example of a reactor manufacturing method for manufacturing the reactor 1 according to Embodiment 1 will be described. The reactor manufacturing method mainly includes the following steps. The reactor manufacturing method will be described with reference mainly to FIG. 3, and to FIGS. 4 and 5 as needed.

Coil production step
Integration step
Assembly step
Filling step
Curing step

Coil Production Step

In this step, a wire 2*w* is prepared, and the coil 2 is produced by winding a portion of the wire 2*w*. A known winding device can be used to wind the wire 2*w*. A covering layer of heat-fusible resin that is to be the integration resin 20 described with reference to FIG. 2 can be formed on the outer circumference of the wire 2*w*. The thickness of the covering layer can be selected as appropriate.

Integration Step

In this step, the winding portions 2A and 2B of the coil 2 produced in the coil production step are integrated with the integration resin 20 (see FIG. 2). If the covering layer of heat-fusible resin is formed on the outer circumference of the wire 2*w*, the integration resin 20 can be formed by subjecting the coil 2 to heat treatment. In contrast to this, if the covering layer is not formed on the outer circumference of the wire 2*w*, it is preferable to apply resin to the outer circumference or inner circumference of the winding portions 2A and 2B of the coil 2 and form the integration resin 20 by curing the resin.

The integration step can be performed after the later-described assembly step and before the filling step.

Assembly Step

In this step, the coil 2, the divided cores 31*m* and 32*m* that constitute the magnetic core 3, and the interposed insulating member 4 are assembled. For example, as shown in FIG. 5, first combined members obtained by arranging the divided cores 31*m* in the storage portions 49 of the inner interposed members 4C and 4D are produced, and the first combined members are arranged inside of the winding portions 2A and 2B (see FIG. 3 as well). Also, the end surface interposed members 4A and 4B are brought into contact with the end surfaces on the one end side and the end surfaces on the other end side in the axial direction of the winding portions 2A and 2B, interposed between the pair of divided cores 32*m*, whereby a second combined member is produced in which the coil 2, the divided cores 31*m* and 32*m*, and the interposed insulating member 4 are combined.

Here, as shown in FIG. 6, in a view of the second combined member in the axial direction of the winding portions 2A and 2B of the divided core 32*m*, the resin filling holes 45 for filling the interiors of the winding portions 2A and 2B with resin are formed on the side edges and upper edge of the divided core 32*m* (outer core portion 32). The resin filling holes 45 are formed by gaps between the through holes 42 (see FIG. 3) in the end surface interposed members 4A and 4B and the outer core portions 32 fit into the through holes 42.

Filling Step

In the filling step, the interiors of the winding portions 2A and 2B in the second combined member are filled with resin. In the present example, injection molding is performed in which the second combined member is arranged in a mold and the mold is filled with resin. The resin is injected from the end surface side (side opposite to the coil 2) of one of the divided cores 32*m*. The resin with which the mold is filled covers the outer circumference of the divided core 32*m* and flows into the interior of the winding portions 2A and 2B via the resin filling holes 45 (FIGS. 2 and 6). At this time, the air in the winding portions 2A and 2B is discharged to the outside through the resin filling holes 45 in the other divided core 32*m*.

As shown in FIG. 2, the resin with which the interiors of the winding portions 2A and 2B are filled not only enters between the inner circumferential surface of the winding portion 2B and the outer circumferential surfaces of the divided cores 31*m*, but also enters between the two adjacent divided cores 31*m* and 31*m* and between the divided cores 31*m* and the outer core portions 32 (divided cores 32*m*), thus forming the gaps 31*g* and 32*g*. The resin with which the winding portions 2A and 2B are filled from the resin filling holes 45 by applying pressure through injection molding spreads sufficiently in the narrow gaps between the winding portions 2A and 2B and the inner core portions 31, and hardly leaks to the outside of the winding portions 2A and 2B. As shown in FIG. 2, this is because the axial direction end surfaces of the winding portion 2B and the end surface interposed members 4A and 4B are in surface contact and the winding portion 2B is integrated with the integration resin 20.

Here, as stated in the description of the winding portions 2A and 2B, in the case of using a coil 2 in which the turns are integrated at the corner portions of the curves in the rectangular tube-shaped winding portions 2A and 2B and a small gap is formed in the flat portion, filling with the resin can be performed from both sides, namely the outside of one divided core 32*m* and the outside of the other divided core 32*m*. In this case, the air is discharged to the outside of the winding portions 2A and 2B through the small gaps formed at the flat portions. Due to the viscosity and surface tension of the resin, the resin hardly leaks at all from the small gaps at the flat portions to the outside of the winding portions 2A and 2B.

Curing Step

In the curing step, the resin is cured through a heat treatment or the like. As shown in FIG. 2, the inner resin portion 5 is cured resin that is located inside of the winding portions 2A and 2B, and the outer resin portion 6 is cured resin that covers the divided cores 32*m*.

According to the above-described reactor manufacturing method, it is possible to manufacture the combination body 10 of the reactor 1 shown in FIG. 1. Also, by integrally forming the inner resin portion 5 and the outer resin portion 6, the filling step and the curing step need only be performed one time each, and therefore the combination body 10 can be manufactured with good productivity. The complete combination body 10 need only be fixed on the mounting plate 9 via the bonding layer 8.

Embodiment 2

The combination body 10 of Embodiment 1 may be stored in a case and embedded in the case with potting resin. For example, the second combined member produced in the assembly step of the reactor manufacturing method in Embodiment 1 is stored in the case and the case is filled with potting resin. In this case, the potting resin that covers the outer circumferences of the divided cores 32*m* (outer core portions 32) is the outer resin portion 6. Also, the potting resin that enters the winding portions 2A and 2B via the resin filling holes 45 (see FIGS. 2 and 6) is the inner resin portion 5.

The invention claimed is:

1. A reactor comprising:

a coil having winding portions that are formed by winding a wire;

a magnetic core that forms a closed magnetic circuit with inner core portions arranged inside of the winding portions and outer core portions arranged outside of the winding portions;

end surface interposed members that are interposed between axial direction end surfaces of the winding portions and the outer core portions; and an inner resin portion that fills spaces between inner circumferential surfaces of the winding portions and outer circumferential surfaces of the inner core portions, wherein the end surface interposed members include turn storage portions that store at least a portion of turns of the axial direction end portions of the winding portions, the end surface interposed members include through holes into which the outer core portions are fit and the end surface interposed members having a cut-out through which a distal end of a respective wire of the winding portions is accommodated, and wherein the end surface interposed members include resin filling holes through which the interiors of the winding portions are filled with resin that forms the inner resin portion, the resin filling holes being spaced apart from the cut-out and wherein the resin filling holes are formed on a side edge and an upper edge of the through holes.

2. The reactor according to claim 1, wherein the coil includes integration resin that is provided separately from the inner resin portion and integrates the turns of the winding portions.

3. The reactor according to claim 1, further comprising:

an outer resin portion that integrates the outer core portions with the end surface interposed members, wherein the outer resin portion and the inner resin portion are connected through the resin filling holes.

4. The reactor according to claim 3, wherein the resin filling holes lead into gaps between the through holes and the outer core portions, and the outer core portions fit into the through holes, and gaps are formed between the outer core portions and the inner core portions by the inner resin portion that has entered the interiors of the through holes.

5. The reactor according to claim 1, wherein the inner core portions are constituted by a plurality of divided cores and the inner resin portion that has entered between the divided cores.

6. The reactor according to claim 1, wherein the inner core portions include a plurality of divided cores, and the reactor includes inner interposed members that are interposed between the inner circumferential surfaces of the winding portions and the outer circumferential surfaces of the inner core portions, and the inner interposed members include storage portions that store the divided cores in a separated state.

7. The reactor according to claim 1, further comprising:

inner interposed members that are interposed between the inner circumferential surfaces of the winding portions and the outer circumferential surfaces of the inner core portions, wherein the inner resin portion is constituted by the same material as at least one of the end surface interposed members and the inner interposed members.

8. The reactor according to claim 1, further comprising:

inner interposed members that are interposed between the inner circumferential surfaces of the winding portions and the outer circumferential surfaces of the inner core portions; and sealing members that are interposed between the inner circumferential surfaces of the winding portions located near the end surface interposed members and the outer circumferential surfaces of the inner interposed members.

9. A reactor manufacturing method for manufacturing a reactor including a coil and a magnetic core that is arranged inside and outside of the coil and forms a closed magnetic circuit, wherein the reactor is the reactor according to claim 1, the method comprising:

an assembly step of arranging the inner core portions inside of the winding portions and storing the axial direction end portions of the winding portions in the turn storage portions of the end surface interposed members; and a filling step of filling spaces between the inner circumferential surfaces of the winding portions and the outer circumferential surfaces of the inner core portions.

10. The reactor manufacturing method according to claim 9, wherein the coil is produced using a wire having a heat-fusible resin on its surface, turns of the winding portions are integrated by melting the heat-fusible resin through a heat treatment, and thereafter the filling step is performed.

11. The reactor manufacturing method according to claim 9, wherein the end surface interposed members include resin filling holes for filling the interiors of the winding portions with the resin, and in the filling step, the interiors of the winding portions are filled with the resin via the resin filling holes.

12. The reactor manufacturing method according to claim 11, wherein in the filling step, the filling with the resin is performed through injection molding.

* * * * *